US009187933B2

(12) United States Patent
Lucas

(10) Patent No.: US 9,187,933 B2
(45) Date of Patent: Nov. 17, 2015

(54) LATCHING SYSTEM

(71) Applicant: Richard Curtis Lucas, Ashland, OR (US)

(72) Inventor: Richard Curtis Lucas, Ashland, OR (US)

( * ) Notice: Subject to any disclaimer, the term of this patent is extended or adjusted under 35 U.S.C. 154(b) by 225 days.

(21) Appl. No.: 14/013,195

(22) Filed: Aug. 29, 2013

(65) Prior Publication Data

US 2014/0062104 A1 Mar. 6, 2014

Related U.S. Application Data

(60) Provisional application No. 61/743,181, filed on Aug. 29, 2012.

(51) Int. Cl.

| | |
|---|---|
| ***E05C 3/00*** | (2006.01) |
| ***E05B 65/52*** | (2006.01) |
| ***A45C 13/22*** | (2006.01) |
| ***E05B 53/00*** | (2006.01) |
| ***E05C 9/02*** | (2006.01) |
| ***E05C 9/18*** | (2006.01) |
| ***G10G 7/00*** | (2006.01) |
| ***A45C 13/10*** | (2006.01) |
| *E05C 3/02* | (2006.01) |

(52) U.S. Cl.

CPC ..... *E05B 65/5253* (2013.01); *A45C 13/1084* (2013.01); *A45C 13/22* (2013.01); *E05B 53/003* (2013.01); *E05C 9/02* (2013.01); *E05C 9/1875* (2013.01); *G10G 7/005* (2013.01); *A45C 2013/226* (2013.01); *Y10T 292/1049* (2013.01)

(58) Field of Classification Search

CPC ..... Y10S 292/37; E05B 63/14; E05B 63/22; E05B 65/5253; E05C 3/004; E05C 9/02; E05C 9/18; E05C 9/1875; E05C 9/1883; A45C 13/12; A45C 13/123; A45C 13/22; A45C 2013/226

USPC ..... 292/44, 45, 50, 53, 54, 218, 240–242; 190/118

See application file for complete search history.

(56) References Cited

U.S. PATENT DOCUMENTS

| | | | | | |
|---|---|---|---|---|---|
| 1,615,944 | A * | 2/1927 | Hetrick | 292/240 |
| 1,711,213 | A * | 4/1929 | Smith | 292/198 |
| 2,708,302 | A * | 5/1955 | Wilkirson | 27/2 |
| 4,365,490 | A * | 12/1982 | Manzoni | 70/70 |
| 4,677,832 | A * | 7/1987 | Remington | 70/67 |
| 4,807,914 | A * | 2/1989 | Fleming et al. | 292/48 |

(Continued)

FOREIGN PATENT DOCUMENTS

| | | | | |
|---|---|---|---|---|
| DE | 19608173 | A1 * | 9/1997 | |
| EP | 1736626 | A2 * | 12/2006 | E05C 9/04 |

(Continued)

*Primary Examiner* — Carlos Lugo

(57) ABSTRACT

A latching system connects a case lid with a plurality of catch cavities to a case body with a plurality of latch-clasp cavities. The latching system has a plurality of latch-clasps connected to the case body with a latch-clasp pivot. A communicating member is attached to each latch clasp with a communicating member pivot. A slide switch is mechanically coupled to the communicating member and has an open mode of operation and a closed mode of operation. Moving the slide switch to the open mode of operation moves the plurality of latch-clasps into each latch-clasp cavity which permits movement of the case lid distant the case body. Moving the slide switch to the closed mode of operation moves the plurality of latch-clasps into each catch cavity which prevents movement of the case lid distant the case body.

4 Claims, 4 Drawing Sheets

(56) References Cited

U.S. PATENT DOCUMENTS

| | | | | |
|---|---|---|---|---|
| 5,172,944 | A * | 12/1992 | Munich et al. | 292/39 |
| 5,603,538 | A * | 2/1997 | Evers | 292/215 |
| 7,164,578 | B2 * | 1/2007 | Wang et al. | 361/679.08 |
| 7,637,540 | B2 * | 12/2009 | Chiang | 292/45 |
| 2002/0047278 | A1 * | 4/2002 | Pauser | 292/48 |
| 2006/0284427 | A1 * | 12/2006 | Borycki | 292/240 |
| 2007/0240462 | A1 * | 10/2007 | James et al. | 70/159 |
| 2011/0100992 | A1 * | 5/2011 | Zhang et al. | 220/324 |

FOREIGN PATENT DOCUMENTS

| | | | |
|---|---|---|---|
| FR | 539334 | * | 6/1922 |
| FR | 2757354 | A1 * | 6/1998 |

* cited by examiner

LATCHING SYSTEM

RELATED APPLICATION

This application claims priority to provisional patent application U.S. Ser. No. 61/743,181 filed on Aug. 29, 2012, the entire contents of which is herein incorporated by reference.

BACKGROUND

The embodiments herein relate generally to devices that can store musical instruments.

Prior to embodiments of the disclosed invention, opened latches on prior art instrument cases often extended in a way as to be nuisance or hazard to nearby persons and/or to instruments. Prior art instrument cases had to be unlatched one latch at a time, which wasted time and could be awkward and cumbersome on larger cases where the case often has to be moved or adjusted to reach all the latches. Embodiments of the present invention solve this problem. The prior art includes: U.S. Patent Application 2011/0100992 filed by Conti; U.S. Patent Application 2007/0240462 filed by James and U.S. Pat. No. 5,172,944 issued to Fuller.

Fuller teaches a multiple point cam-pinion door latch that has a plurality of latches which can roll into slots to secure a door. However, there is no coordination between the door latches and the handle, which makes since for "multiple door enclosures" but does not work for carrying cases which need a handle that can move a container. James teaches a carrying case with a handle but disconnects the handle from the latching mechanism and attaches it to the side of the case. Conti teaches a latching case with no handle and seems to indicate the user is better carrying it without one.

SUMMARY

A latching system is configured to connect a case lid with a plurality of catch cavities to a case body with a plurality of latch-clasp cavities. The latching system comprises a plurality of latch-clasps. Each latch-clasp is rotationally coupled to the case body with a latch-clasp pivot. A communicating member is attached to each latch clasp with a communicating member pivot. A slide switch is mechanically coupled to the communicating member. The handle has an open mode of operation and a closed mode of operation. Moving the slide switch to the open mode of operation moves the communicating member thus the communicating member pivot and rotates the plurality of latch-clasps into each latch-clasp cavity which permits movement of the case lid distant the case body. Moving the slide switch to the closed mode of operation moves the communicating member thus the communicating member pivot and rotates the plurality of latch-clasps into each catch cavity which prevents movement of the case lid distant the case body.

In some embodiments, the case body further comprises a handle cavity. The handle cavity is perforated with two handle pivots wherein each handle pivot is attached to the handle. A slide switch is mechanically coupled to the case body and prevents movement of the handle without completing a mechanical test.

In some embodiments, each catch cavity further comprises a catch port and a latch protrusion. Each latch-clasp comprises a latch-clasp catch arm and a latch indent. The closed mode of operation involves the latch indent immediately adjacent to the latch protrusion and the catch port immediately adjacent to the latch-clasp catch arm. Each latch-clasp is a horizontal cylindric segment modified with a flat edge extended around the latch-clasp pivot to avoid structural failure near the latch-clasp pivot.

BRIEF DESCRIPTION OF THE FIGURES

The detailed description of some embodiments of the invention is made below with reference to the accompanying figures, wherein like numerals represent corresponding parts of the figures.

DETAILED DESCRIPTION OF CERTAIN EMBODIMENTS

Figure 1:
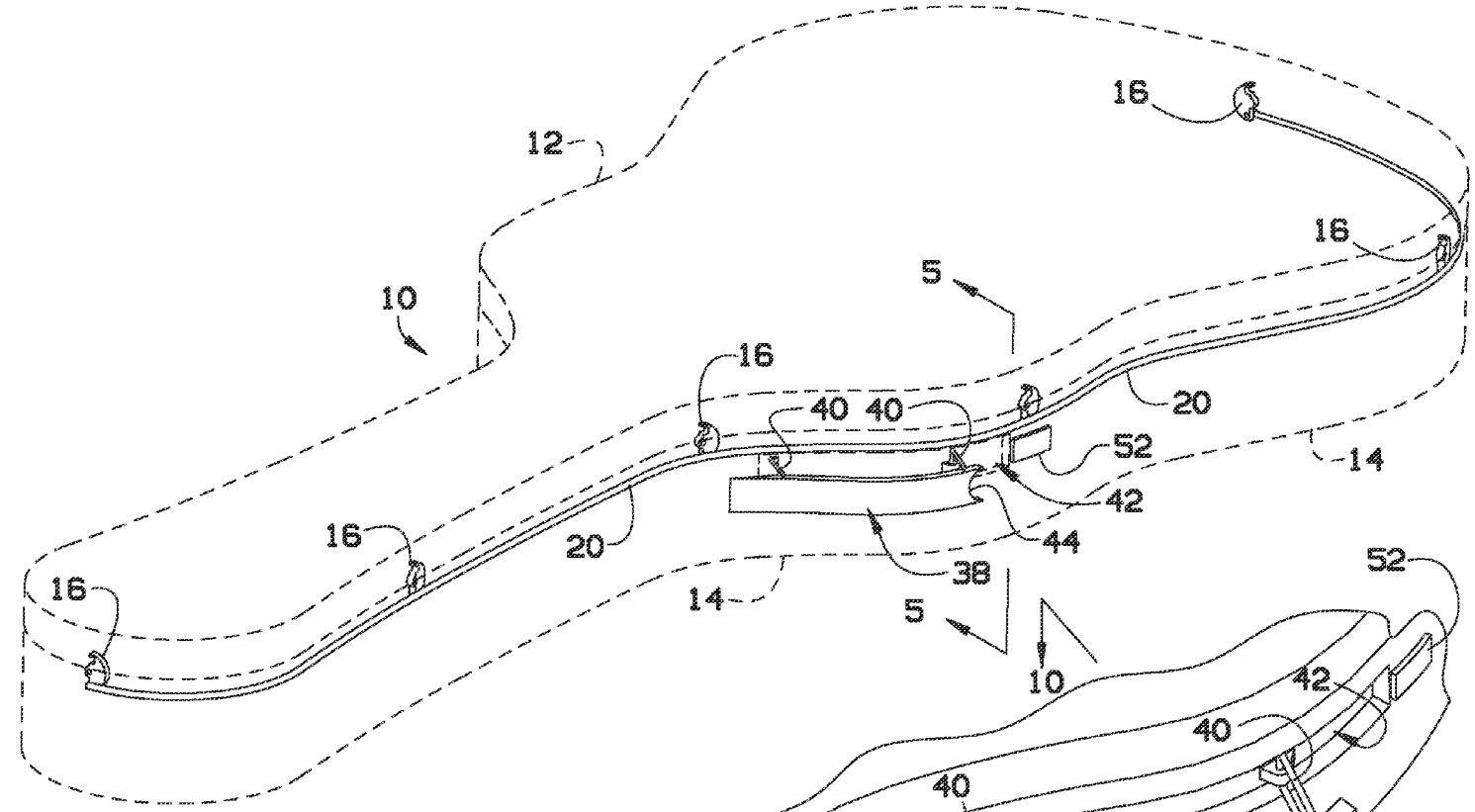
FIG. 1 is a perspective detail view of an embodiment of the invention show in locked configuration.

By way of example, and referring to FIG. 1, one instrument case lid 12 is attached to instrument case body 14 with latching system 10. Latching system 10 comprises a plurality of latch-clasps 16 connected to one another with communicating member 20.

Figure 2:
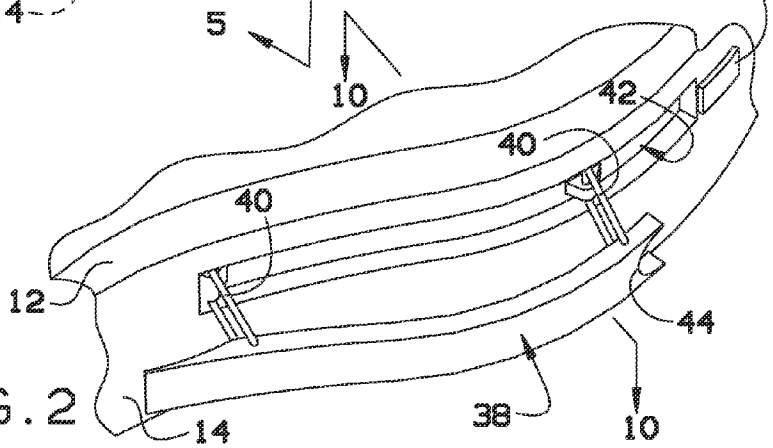
FIG. 2 is a perspective detail view of an embodiment of the invention demonstrating the handle in extended configuration.

Turning to FIG. 1 and FIG. 2, case body 14 further comprises handle cavity 42. Handle cavity 42 is perforated with two handle pivots 40. Each handle pivot 40 is attached to handle 38. In order to engage handle 38, a user must move slide switch 52 which is mechanically coupled to case body 14 and covers a portion of handle 38. Slide switch 52 is connected to communicating member 20 which engages latch-clasp 16 as shown in FIG. 3, FIG. 4 and FIG. 5.

Figure 4:
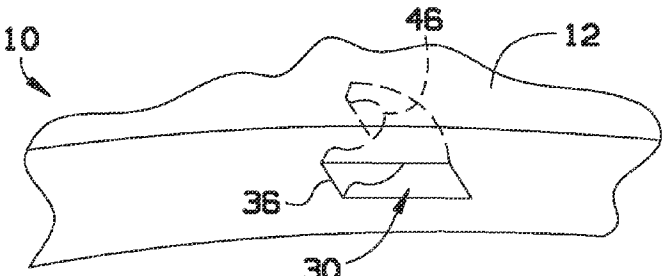
FIG. 4 is a bottom perspective detail view of the guitar case swing lid.
Figure 3:
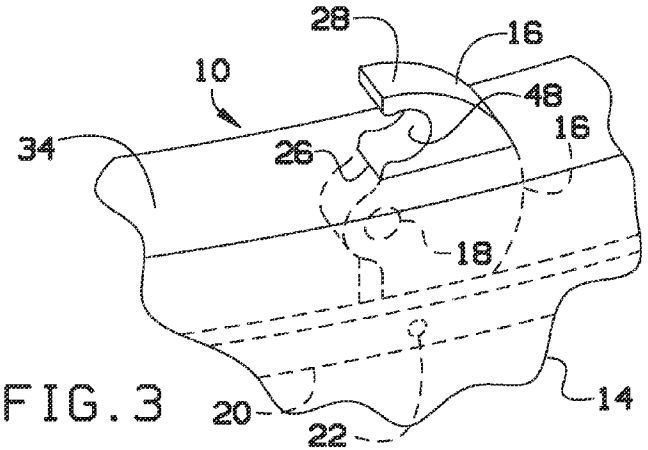
FIG. 3 is a perspective detail view of the guitar case body only and associated components demonstrating the latch-clasp in extended configuration.
Figure 5:
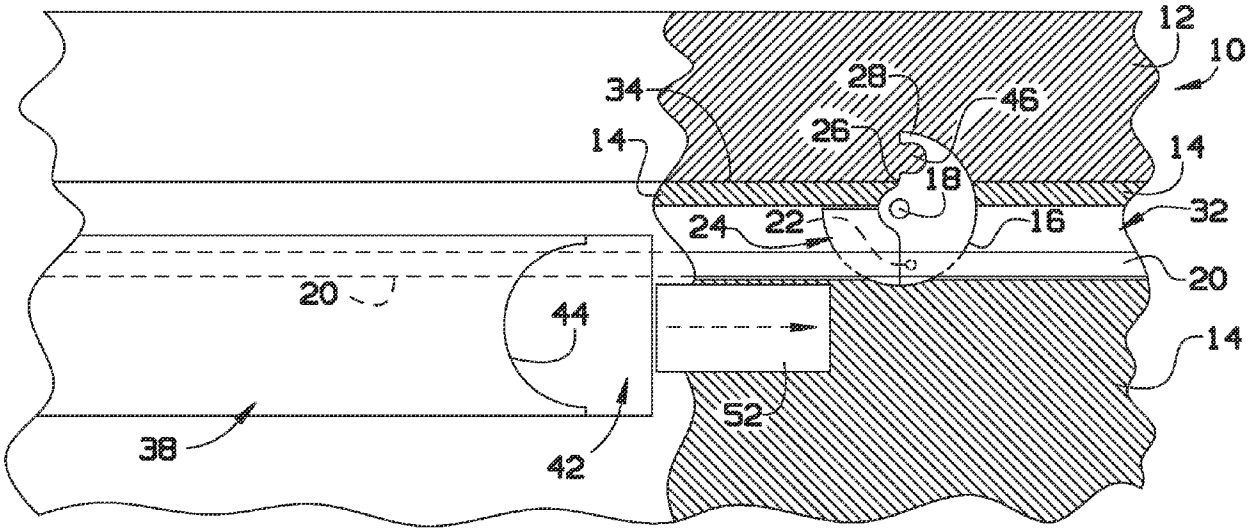
FIG. 5 is a section detail view of the invention along line 5-5 in FIG. 1.

FIG. 3, FIG. 4 and FIG. 5 show latching system 10 in more detail. Case lid 12 comprises catch cavity 30. Catch cavity 30 further comprises catch port 36 and latch protrusion 46.

Case body 14 comprises an upper surface, case rim 34. Case body 14 is perforated with communicating member channel 32 through which communicating member 20 travels from one latch-clasp 16 to another. Case rim 34 is perforated latch-clasp cavity 24 that accommodates latch-clasp 16 through latch-clasp port 26. Latch-clasp 16 is rotationally coupled to case body 14 with latch-clasp pivot 18. Latch-clasp 16 is mechanically coupled to communicating member 20 with communicating member pivot 22.

Latch-clasp 16 comprises latch clasp catch arm 28 and latch indent 48. Latch clasp arm 28 can rotate through catch cavity 30 and into latch protrusion 46. In more geometric detail, latch clasp takes the shape of a horizontal cylindric segment modified as follows. A flat edge is extended around latch-clasp pivot 18 to avoid structural failure near latch-clasp pivot 18. The flat edge further possesses a three-dimensional letter U portion called the latch clasp arm 28.

Figures 6, 7, 8:
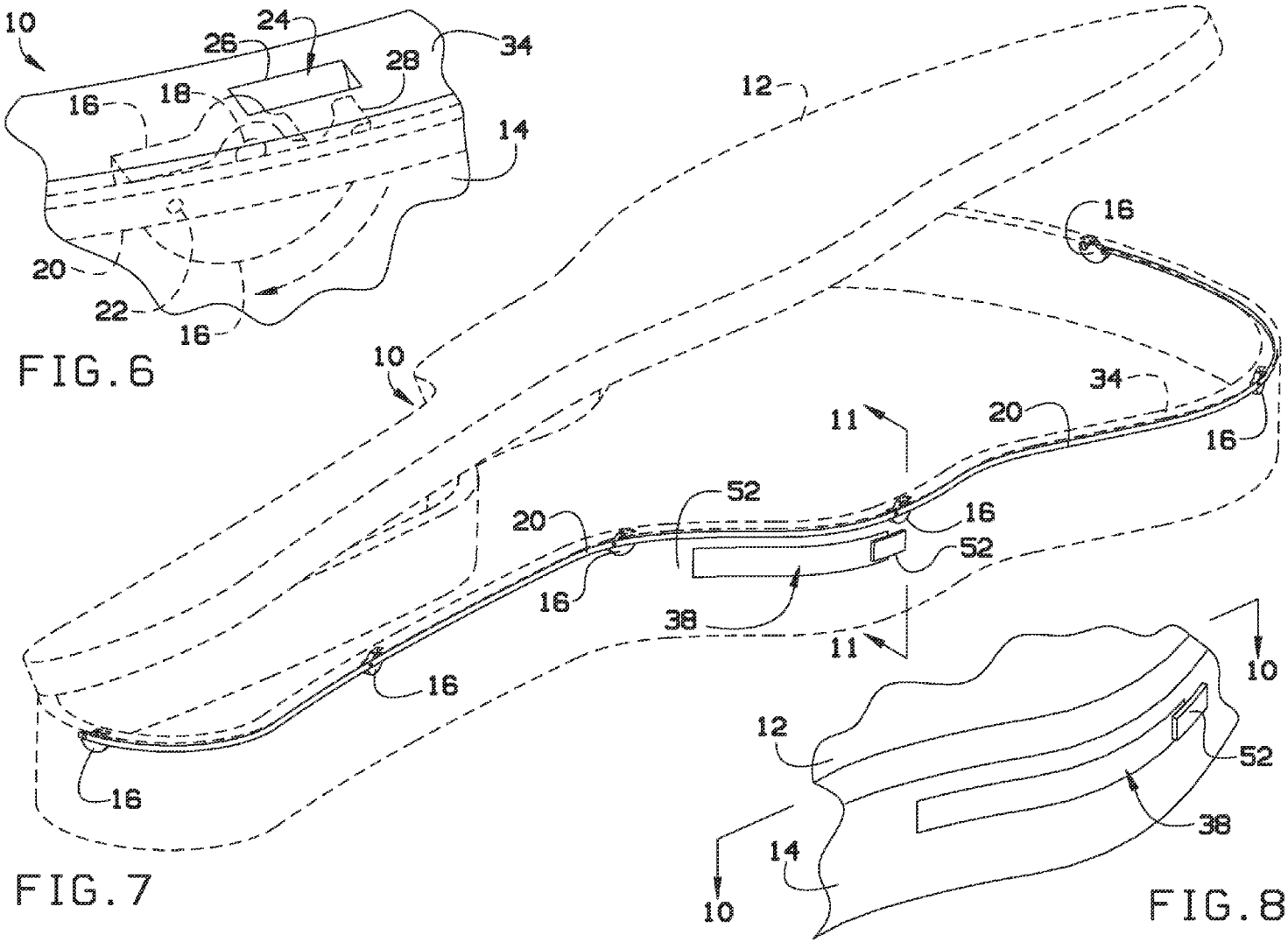
FIG. 6 is a perspective detail view of an embodiment of the guitar case body only and associated components demonstrating the latch-clasp in refracted configuration.
FIG. 7 is a perspective detail view of an embodiment of the invention shown in unlocked configuration.
FIG. 8 is a perspective detail view of an embodiment of the invention demonstrating the handle in retracted configuration, with latch-clasps unlatched.

As shown in FIG. 6, when communicating member 20 moves in a first direction, communicating member pivot 22 rotates about latch-clasp pivot 18. This causes latch clasp arm 28 to descend beneath case rim 34. Likewise, as demonstrated in FIG. 12, when communicating member 20 moves in a second direction, communicating member pivot 22 rotates about latch-clasp pivot 18. This causes latch clasp arm 28 to ascend above case rim 34 and into latch-clasp port 26. In some embodiments, instead of using latch-clasp pivot 18 in case body 14, a user can instead have pin 50 inserted through latch-clasp port 26 and latch-clasp 16.

Figure 12:
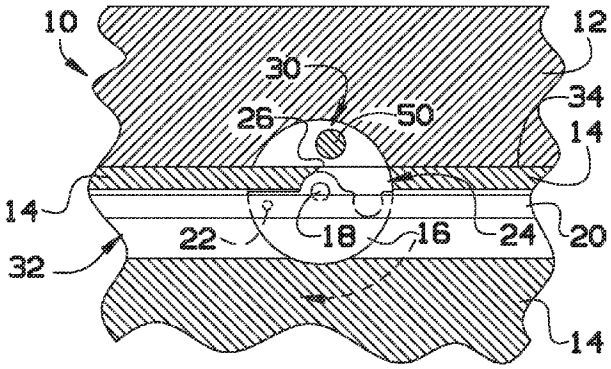
FIG. 12: is a section detail view of an embodiment of the invention.

FIG. 7 shows the motion of FIG. 6 and FIG. 12 in the broader context of the plurality of latch-clasps 16 moving in unison. All of latch-clasps 16 move as a result of the motion of motion of communicating member 20. While the drawings depict a mechanical linkage assembly, other embodiments can include direct current actuators proximate each latch-clasp 16 and communicating member 20 would be an electrical wire. There are plurality of catch cavities 30 within case body 14 and a plurality of latch-clasp cavities 24 within case lid 12.

Figure 11:
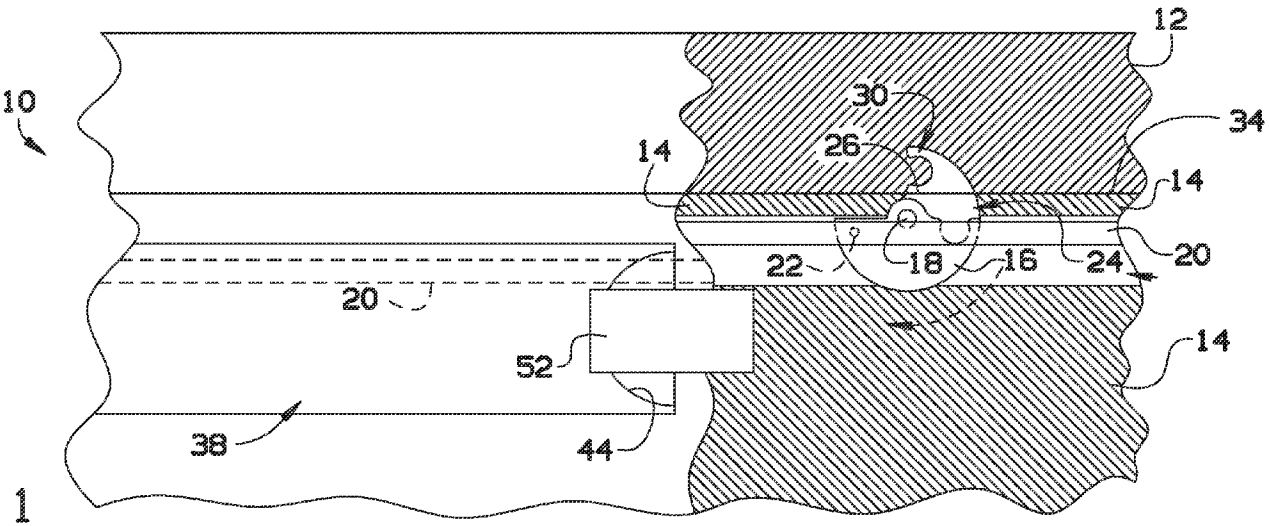
FIG. 11 is a section detail view of an embodiment of the invention along line 11-11 in FIG. 8.
Figure 9:
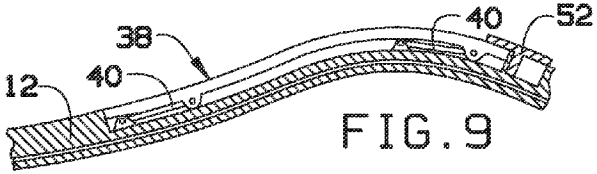
FIG. 9 is a section detail view of an embodiment of the invention along line 9-9 in FIG. 7.
Figure 10:
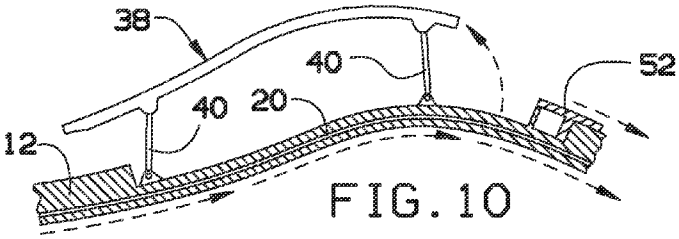
FIG. 10 is a section detail view of an embodiment of the invention along line 10-10 in FIG. 2.

FIG. 9, FIG. 10 and FIG. 11 show movement of slide switch 52. FIG. 9 shows moving slide switch 52 to an open mode of operation that moves communicating member 20 thus communicating member pivot 22 which rotates the plurality of latch-clasps 16 into the latch-clasp cavity 24 permitting movement of case lid 12 distant case body 14. FIG. 10 shows moving slide switch 52 to a closed mode of operation that moves communicating member 20 thus the communicating member pivot 22 and rotates the plurality of latch-clasps 16 into the latch-clasp port 26 preventing movement of the case lid distant the case body As handle 38 moves, handle pivots 40 move. However, a user can lock handle 38 and prevent latch-clasps 16 from moving slide switch 52 over handle 38 requiring a mechanical test to access handle 38. Alternately, a user can move slide switch 52 away from handle 38 and then move handle 38 from handle cavity 38 by using a finger in finger notch 44 upon handle 38. In some embodiments, handle pivots 40 can be mechanically coupled to communicating member 20 instead of slide switch 52.

This construction ensures that all parts of the latching system remain safely out of the way when either open or shut, and that a plurality of latch-clasps can be operated from one control. Additionally, all latch-clasps 16 can act simultaneously through the agency of communicating member 20. In some case, communicating member 20 can be a spring or cable.

Persons of ordinary skill in the art may appreciate that numerous design configurations may be possible to enjoy the functional benefits of the inventive systems. Thus, given the wide variety of configurations and arrangements of embodiments of the present invention the scope of the invention is reflected by the breadth of the claims below rather than narrowed by the embodiments described above.

What is claimed is:

1. A storage device, comprising:

a case body comprising a plurality of latch clasp cavities;

a case lid pivotally attached to the case body, said case lid comprising a plurality of catch cavities;

a latching system comprising:

a plurality of latch-clasps wherein each latch-clasp is rotationally coupled to the case body with a latch-clasp pivot;

a communicating member attached to each latch clasp with a communicating member pivot; and a slide switch mechanically coupled to the communicating member; wherein the slide switch has an open mode of operation and a closed mode of operation;

the storage device further comprises:

a handle, pivotally attached to said case body and configured to be moved between a storage position within the case body and an exposed position;

wherein, moving the slide switch from the closed mode of operation toward the open mode of operation, the handle is configured to be moved to the storage position and the slide switch is configured to 1) move above the handle, securing the handle in the storage position, and 2) move the communicating member thus the communicating member pivot and rotates the plurality of latch-clasps into each latch-clasp cavity, which permits movement of the case lid distant the case body;

wherein, moving the slide switch from the open mode of operation to the closed mode of operation, the slide switch is configured to move the communicating member thus the communicating member pivot and rotates the plurality of latch-clasps into each catch cavity which prevents movement of the case lid distant the case body and is configured to move away from above the handle, allowing the handle to be moved to the exposed position allowing a user to grasp the handle to carry the storage device.

2. The latching system of claim 1, wherein the case body further comprises a handle cavity; the handle cavity is perforated with two handle pivots wherein each handle pivot is attached to the handle.

3. The latching system of claim 1, wherein the case body further comprises a handle cavity; the handle cavity is perforated with two handle pivots wherein each handle pivot is attached to the handle; the slide switch is mechanically coupled to the case body and prevents movement of the handle without completing a mechanical test.

4. The latching system of claim 1, each catch cavity further comprises a catch port and a latch protrusion; and each latch-clasp comprises a latch-clasp catch arm and a latch indent;

wherein the closed mode of operation involves the latch indent immediately adjacent to the latch protrusion and the catch port immediately adjacent to the latch-clasp catch arm.

* * * * *